United States Patent [19]

Christian

[11] Patent Number: 5,060,432

[45] Date of Patent: Oct. 29, 1991

[54] MODULAR PANEL

[76] Inventor: William D. Christian, P.O. Box 338, Moncure, N.C. 27559

[21] Appl. No.: 623,354

[22] Filed: Dec. 7, 1990

[51] Int. Cl.[5] ..... E04B 1/10

[52] U.S. Cl. ..... 52/233; 52/656; 52/284

[58] Field of Search ..... 52/233, 478, 312, 284, 52/578, 813, 656

[56] References Cited

U.S. PATENT DOCUMENTS

| | | | |
|---|---|---|---|
| 909,787 | 1/1909 | Hanley | 52/813 |
| 1,801,093 | 4/1931 | Larkins . | |
| 2,101,349 | 12/1937 | Sharp | 52/656 |
| 2,226,332 | 12/1940 | Bacci | 52/578 |
| 2,269,926 | 1/1942 | Crooks . | |
| 2,269,927 | 1/1942 | Crooks . | |
| 2,661,511 | 12/1953 | Weyerhaeuser . | |
| 4,115,969 | 9/1978 | Napier | 52/284 |
| 4,512,131 | 4/1985 | Laramore . | |
| 4,575,982 | 3/1986 | Wenger . | |
| 4,747,231 | 5/1988 | LeMay . | |

*Primary Examiner*—David A. Scherbel
*Assistant Examiner*—Wynn E. Wood
*Attorney, Agent, or Firm*—Olive & Olive

[57] ABSTRACT

A modular panel system for constructing buildings. Wall and floor panels are made from column structures which form fit so that they slide together to create the panel. The junction between the columns is formed by matching the protrusions and receptacles on each of the columns, one side being the reverse counterpart of the other. The column structures may vary in design according to different structural and aesthetic considerations.

25 Claims, 3 Drawing Sheets

MODULAR PANEL

BACKGROUND OF THE INVENTION

1. Field of the Invention

This invention relates to modular panels constructed from columns or planks which are cut to allow them to interconnect and be used as wall and floor panels.

2. Description of the Related Art

Use of modular panel systems in building construction is well known. The ease, convenience and cost of modular systems make them popular for use in construction. Previous methods of building having modular panel pieces include those in which the pieces are fitted together with a tongue and groove structure cut into the pieces themselves (for example, Wenger, U.S. Pat. No. 4,575,982 and Crooks, U.S. Pat. Nos. 2,269,926 and 2,269,927), or by constructing a separate tie bar or spline member to be inserted between or across the pieces (for example, Laramore, U.S. Pat. No. 4,512,131 and Weyerhaeuser, U.S. Pat. No. 2,661,511).

Log sections have also been fastened together to form a landscape edging by insertion of a length of strip material (LeMay et al., U.S. Pat. No. 4,747,231).

The present invention, however, removes the need for constructing the pieces with a tongue and groove and allows joining of pieces of wood, that are thicker than an average plank or paneling lumber, to form a panel.

An object of this invention is to provide a unit and method for creating modular panels to be used for building construction which are easy to construct.

Further objectives and advantages of the present invention will become apparent as the following description proceeds with reference to the accompanying drawings.

SUMMARY OF THE INVENTION

The present invention discloses a modular panel system having panels which may be used for wall or floor panels. The panels are constructed from columns or planks (hereafter called columns) which are cut so that adjacent columns easily fit together to create a panel. Once the columns are joined, a frame or joist structure is attached to create the panel for use as a wall or floor.

The columns out of which the panels are made may be constructed from a variety of materials, for example, wood, foam core plywood, reinforced molded foam, or molded and reinforced VERMICULITE TM. Preferably they are constructed from logs or log halves and have a width of about 5 inches and a height of about 2 to 2½ inches depending on the version of column being constructed. If logs are used to construct exterior wall panels, then a building having an appearance similar to a log cabin or storage building may be built through the use of the modular panel system of the invention. The logs may be sized by turning the timber in a turning lathe or other appropriate equipment until a diameter of 5¼ to 5½ inches is reached. It may also be possible to use as columns log cores which remain after the wood used for making veneer is removed from the log. The use of logs for the modular wall panels permits the construction of a log cabin type building without the arduous process of stacking logs for the building structure.

The invention contemplates two primary versions of the columns. These versions are discussed more fully below. The columns are constructed so that they slip together to create a panel. This form fit is accomplished through the use of a protrusion and a receptacle being cut from two sides of each of the internal columns and from at least one side of the external columns as the columns are arranged in the panel.

After the columns of the wall panel are fit together, they may be secured together with liquid nails or other wood seals. The columns of the wall panel are further enforced by the use of an x-frame placed onto the inside face of the wall panel. This frame may be attached to the wall panel by any conventional means, for example, nails, liquid nails, staples, or corrugated clips or a combination thereof. The x-frame will generally be placed on the wall panels at the time of assembly. At that time the columns and x-frame may be glued and clamped together until set. Insulation may be placed into the x-frame and conventional interior wall board or other wall coverings, for example dry wall or sheet rock, may be placed directly on the x-frame.

The wall panel itself is strong enough to aid in roof support. When a wall panel is adjoined to a floor panel the wall panel may extend below the floor panel to create an overhang which aids in preventing rain and standing water from entering the building interior and in diverting water to drip off the overhang onto the ground instead of into the building. This extension of the wall panel may act as a construction anchorage, tightening up the joint where the wall panel meets the floor panel. The modular wall panels of this invention may be used for interior as well as exterior walls or as ceiling panels, in which case the x-frame could be eliminated from the panel and the whole panel made thinner.

The floor panel may be attached to a building's foundation or by attaching it to directly to foundation girders. The entire floor panel may be treated with a salt treatment to protect the panels from termite infestation. This is particularly important for floor panels in locales where termites may present a problem. If desired, the wall panel may also be treated in this manner.

A joist system is attached to the top face of the floor panel. The joist system is formed by placing joists both lengthwise and widthwise on the face of the panel; joists are placed along the perimeter of, and at various intervals across, the floor panel. Additionally, one joist spans the length of the floor panel down its center point. The joists are joined together, like the wall panel beams, with corrugated clips, nails, or liquid nails, and nailed to the floor panel.

Insulation, for example mineral or rock wool, may be placed between the joists on the floor panel, thus accomplishing the task of insulating the floor. Onto the joists flake board or press board may be attached, with its smooth side up, and covered with liquid vinyl to create a durable and versatile floor covering. Alternatively, other flooring and floor coverings known in the art may be used.

It is contemplated that the panels be pre-constructed prior to construction of a building, and standardized to enable them to be mass produced. However, it is possible to vary the standard size and design according to specific construction needs.

Because the panel construction is durable and rugged, it is also contemplated that the panels will be resistant to hurricane winds, high winds and earthquakes. Even if the panels experience some weather damage, it is believed that many of the panels would be salvageable as whole pieces.

Other aspects and features of the invention will be more fully apparent from the following disclosures and appended claims.

DETAILED DESCRIPTION OF THE INVENTION AND THE PREFERRED EMBODIMENT THEREOF

The invention is a modular panel system, its component panels and the component columns of the panels. In particular, the modular panel system comprises:

(a) wall panels, each wall panel being fastenable to other wall panels and a roofing assembly; and (b) floor panels, each floor panel being fastenable to other floor panels and to a wall panel, wherein each of said wall panels and floor panels comprises a plurality of columns, each of said columns comprising:

(i) a flat first side;

(ii) a second side opposite said first side;

(iii) a third side, a portion of which third side is perpendicular to said first side, said third side having a receptacle adjacent said first side and a protrusion adjacent said second side; and (iv) a fourth side, a portion of which fourth side is perpendicular to said first side, said fourth side having a protrusion adjacent said first side and a receptacle adjacent said second side; wherein the third and fourth sides of two adjacent columns may be fit together by insertion of the protrusion on the third side of a first column into the receptacle on the fourth side of a second column, and insertion of the protrusion on the fourth side of said second column into the receptacle on the third side of said first column, and wherein a plurality of adjacent columns may be joined together by said protrusions and receptacles to form sets of columns;

and wherein each of said wall panels comprises:

(i) an inside face, formed by the first side of each column of a first set of columns, said inside face having a bottom portion into which a floor panel fits, and (ii) an outside face formed by the second side of each column of said first set of columns;

and wherein each of said floor panels comprises:

(i) a top face being formed by the first side of each column of a second set of columns, and (ii) a bottom face being formed by the second side of each column of said second set of columns.

Figure 1:
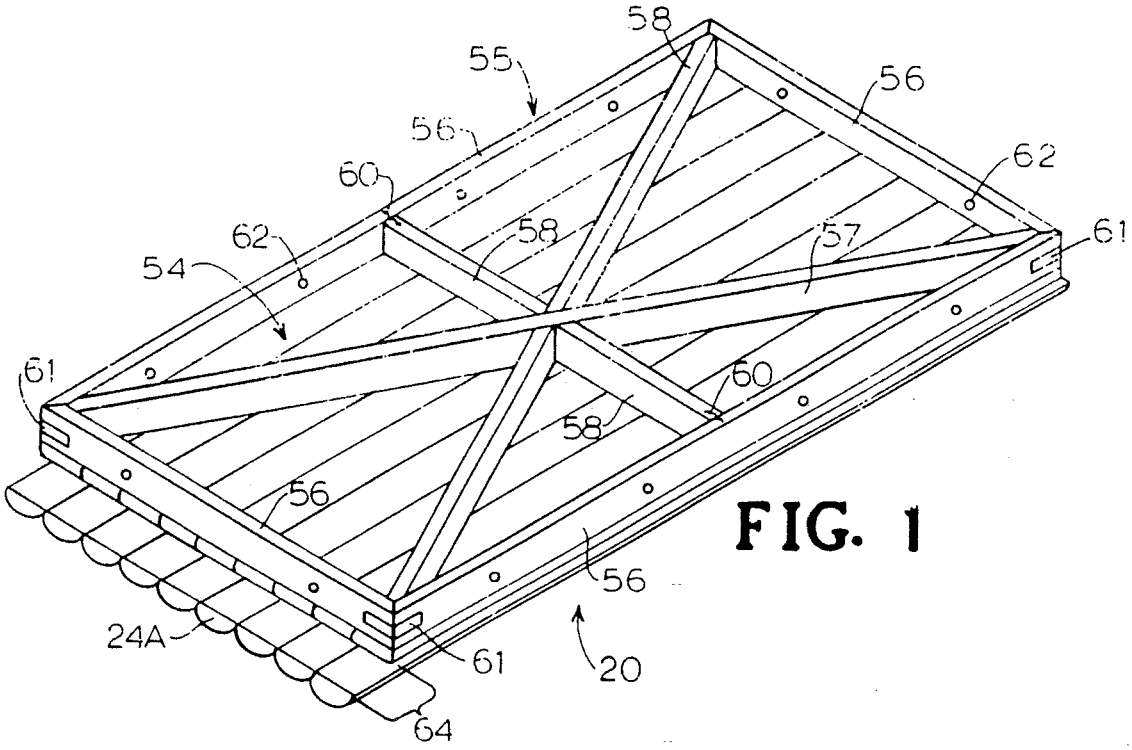
FIG. 1 is a perspective view of the inner side of the modular wall panel.
Figure 2:
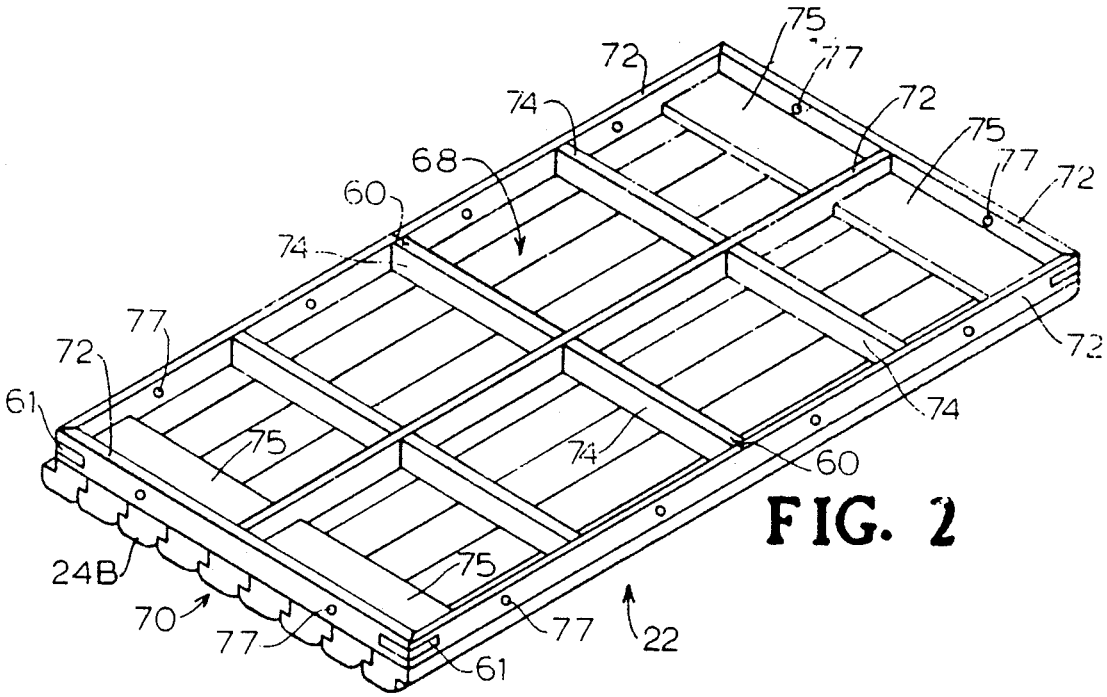
FIG. 2 is a perspective view of the modular floor panel.
Figure 6:
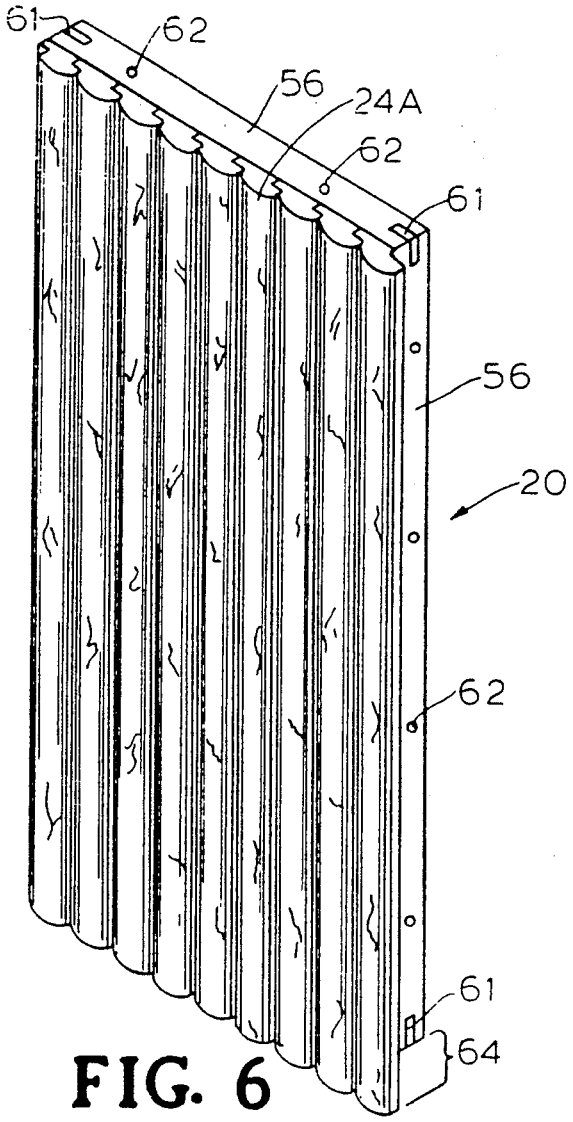
FIG. 6 is a perspective view of the outer side of the modular wall panel.

As shown in FIGS. 1, 2, and 6 the modular panel system of the invention includes a wall panel 20 and a floor panel 22, each of which is constructed of columns 24A or 24B.

Each column may be formed according to the various embodiments discussed below using a method of wood forming and cutting known in the art. Preferably, a one-site operation may be used in which a raw log is debarked, placed on a sawmill log carriage, and split in half down the length of the log. The halves are then sized to the appropriate width and height. The sized log is preferably placed in a molding or planing machine used to cut the log so that its cross sectional form is according to the column embodiment being made. For example, a Model A 20 (Yates-American Machine Co., Greensboro, N.C.) may be used to mold the column.

Figure 3:
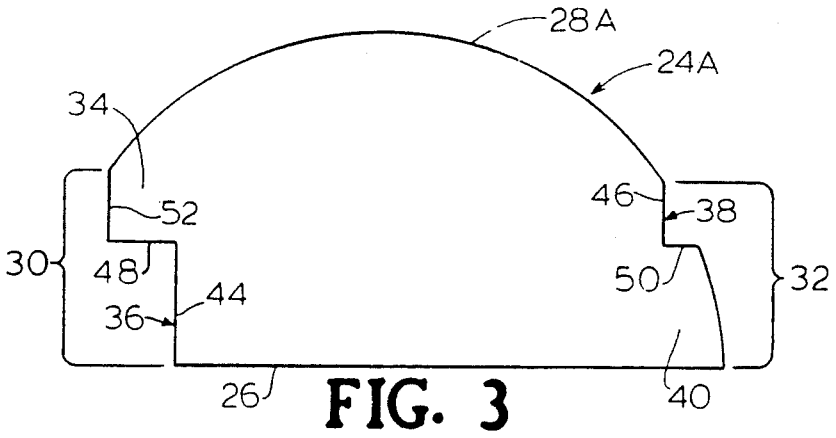
FIG. 3 is a line-drawing showing the outline of a cross-sectional view of a first embodiment of a column of the invention.
Figure 4:
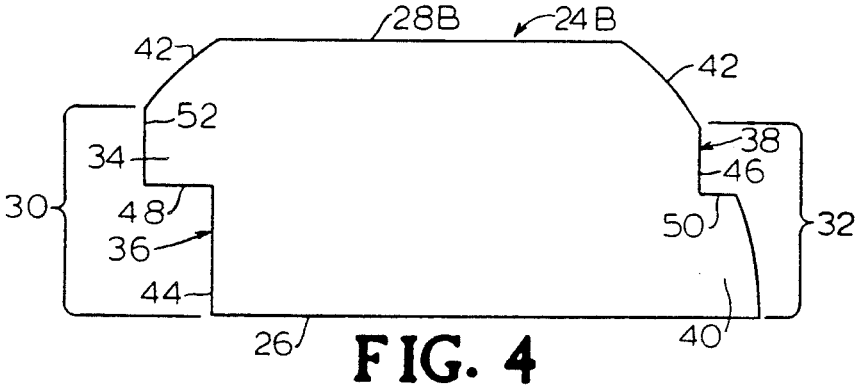
FIG. 4 is a line-drawing showing the outline of a cross-sectional view of a second embodiment of a column of the invention.

Column 24 may be configured in at least two versions or embodiments, hereinafter described as columns 24A and 24B (shown in cross-section in FIGS. 3 and 4, respectively). Each type of column 24 has a first flat inner surface 26, either a second side 28A or 28B opposite said first side 26 and used for the outer surface of a panel, and a third side 30 and a fourth side 32, which are oppositely disposed from each other on column 24 and perpendicular to the flat inner surface 26. Third side 30 contains upper protrusion 34 and lower receptacle 36. Fourth side 32 contains upper receptacle 38 and lower protrusion 40. These two sides are shaped so that third side 30 and fourth side 32 fit together when two columns 24 are aligned adjacent to each other as shown in FIGS. 1 and 2. For purposes of this description, two preferred arrangements of the protrusions and receptacles of the sides will be discussed; however, it is possible to vary somewhat the shape of the protrusion and the corresponding receptacle.

The differences existing in the types of columns 24 occur in second side 28. Column 24A has as its second side 28 a rounded outer surface. Column 24B has a flat outer surface as its second side 28B with a sloped area 42 sloping down, outwardly extending from the flat outer surface of second side 28B. This shape is created by the partial removal of a portion of the rounded outer surface of second side 28A of column 24A.

In each column, receptacles 36 and 38 are made by cutting out a section from the columns by making a vertical cut, perpendicular to inner surface 26, to form edge 44 of receptacle 36 adjacent inner surface 26 and edge 46 of receptacle 38 adjacent second side 28. A horizontal second cut is made which is parallel to inner surface 26, forming parallel edge 48 of receptacle 36, and parallel edge 50 of receptacle 38. Upper cut 52 which is perpendicular to inner surface 26 and parallel to edge 46 is also made. When the cuts are made and those portions between and outside the cuts removed, protrusions 34 and 40 remain on the sides 30 and 32, respectively.

Columns 24 are joined by sliding together two adjacent columns 24, shown in FIGS. 1 and 2. Specifically, upper protrusion 34 of a first column 24 fits into upper receptacle 38 of an adjacent second column 24. Lower protrusion 40 of the second column 24 fits into lower receptacle 36 of the adjacent first column 24. Columns 24 slide easily together because receptacles 36 and 38 generally are the inverse shapes of protrusions 34 and 40, with the exception that in the preferred embodiment, protrusion 40 is not squared off but retains a rounded exterior surface. Upon joining columns 24, upper cut 52 and parallel edge 48 of one column 24 meets with perpendicular edge 46 and parallel edge 50 of the adjacent column 24. Columns 24 may be secured together with any conventional means; however liquid nails is a preferred method because of the convenience and appearance of liquid nails.

Wall panel 20, shown generally in FIGS. 1 and 6, is constructed from a plurality of adjoined columns 24 and generally results in a panel measuring approximately four (4) feet by eight (8) feet, although it could be constructed to a different size. If wall panel 20 is to be used for an exterior wall, particularly an exterior wall for a log cabin structure, column 24A is used to allow the log's rounded outer surface of second side 28A to create the exterior wall surface having an appearance of logs shown in FIG. 6. However, either of the column types may be used for exterior or interior walls. Inside face 54 of wall panel 20 corresponds to the adjoining inner surfaces 26 of columns 24.

To further secure and strengthen wall panel 20, x-frame 55, approximately forty-eight (48) inches wide, is attached to inside face 54 of wall panel 20 by liquid nails, nails or building staples. X-frame 55 is made of nine beams. Four perimeter beams 56 are placed along the perimeter of inside face 54 and are mitered where perimeter beams 56 meet each other in a 45 degree angle to form four corners. One-cross beam 57 is placed diagonally, connecting two opposite corners of x-frame 55. Two short beams 58 each cross diagonally across inside face 54, extending from each of the other two opposite corners of x-frame 55 to the center point of inside face 54; two other short beams 58 extend vertically in from the sides of perimeter beams 56 to the center point of inside face 54, shown in FIG. 1.

The beams 56, 57 and 58 are secured together at every joint with corrugated clips 60 (shown twice), insertable by an air gun, or nails, or a combination of both. The outside corners of x-frame 55, where perimeter beams 56 meet, may contain corner brackets 61 to further secure x-frame 55. Grooved areas, coinciding with the dimensions of corner brackets 61, may be routed out of each perimeter beam 56 to allow the insertion of corner brackets 61. As previously discussed, insulation may be placed inside x-frame 55 between beams 56, 57 and 58, and conventional wall covering may be placed on top of x-frame 55 to create the interior wall, for example sheet rock or dry wall.

Figure 5:
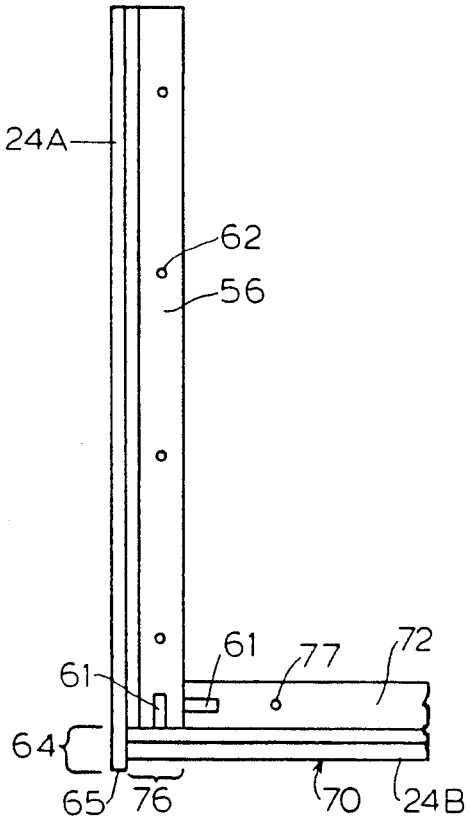
FIG. 5 is an elevational cross-sectional view of the modular wall panel of FIG. 1 adjoined with the modular floor panel of FIG. 2.

Wall panel 20 preferably has bottom portion 64 to aid in joining a wall panel 20 to a floor panel 22 shown in FIGS. 1 and 5. Bottom portion 64 is less high than the full thickness of a column 24 and may form overhang 65 shown in FIG. 5. The manner in which wall panel 20 joins floor panel 22 is discussed below. The top portion of wall panel 20 joins to a roof truss system known in the art by conventional building means.

It may be necessary for fitting panels, for example on a corner or an end wall panel 20, to eliminate from the outside column 24 any protrusion 34 or 40, or any receptacle 36 or 38, by cutting the edge flat. However, interior wall panels 20 join without creating a flat outer column 24. FIGS. 1 and 6 show an uncut outer column 24 on wall panel 20.

Joining wall panels 20 to other wall panels 20 may be accomplished in the following manner. First the outermost columns 24 of an adjacent wall panel 20 are secured together with liquid nails or with another appropriate wood seal. Second, x-frame 55 of one wall panel 20 is attached to x-frame 55 of an adjacent wall panel 20 by using bolts, nuts and washers at various intervals along x-frame 55 at attachment points 62.

Floor panel 22, shown generally in FIG. 2, has top face 68 and bottom face 70. Top face 68 corresponds to inner surface 26 of columns 24. Bottom face 70 corresponds to outer surface of second side 28B of columns 24B. While column 24A may be used for floor panel 22, the flattened outer surfaces of second side 28B of columns 24B serve as a more stable base for floor panel 22. To top face 68, four perimeter joists 72 are attached along each outer edge of floor panel 22 and are mitered to meet each other in a 45 degree angle. A fifth joist 72 is attached to top face 68 down its vertical center extending the length of floor panel 22, and is attached to two of the perimeter joists 72. Cross-joists 74 are attached at various intervals in between joists 72. Six cross-joists 74 are shown and are the preferred number for a 4'×8' floor panel 22. Together these joists 72 and cross-joists 74 form a joist structure above top face 68 of floor panel 22. Joists 72 and cross-joists 74 are secured together at every joint with corrugated clips 60, nails or a combination. The outside corners, where perimeter joists 72 meet at 45 degree angles, may contain corner brackets 61, in the same manner described for x-frame 55 on wall panel 20. Boards 75, approximately four (4) inches wide, and made out of half-inch (½") plywood, attach to top face 68 with liquid nails or nails at the four corners of top face 68 of floor panel 22. Boards 75 aid in securing and strengthening floor panel 22, and in securing floor panels 22 to building foundation seals.

The exact placement of joists 72 and cross-joists 74 on top face 68 of floor panel 22 depends on whether the floor panel 22 will be one which attaches only to other floor panels 22, or one which attaches to a wall panel 20. If the floor panel 22 is to be attached only to other floor panels 22, perimeter joists 72 are placed so that they are flush with the ends of columns 24 as shown in FIG. 2. However if floor panel 22 is to be attached to a wall panel 20, joists 72 may be placed at a distance in from the perimeter edge of columns 24 forming a lip 76, shown in FIG. 5. FIG. 5 shows lip 76 being formed by the tips of columns 24. Lip 76 abuts bottom portion of wall panel 20 when floor panel 22 is joined with wall panel 20; the remaining bottom portion 64 forming overhang 65.

Joining floor panels 22 to other floor panels 22 may be accomplished by using bolts, washers and nuts at attachment points 77 located at varying intervals along perimeter joists 72. Nails could also be used, but they are less effective as securing means. A rubber material may also be placed on the ends of floor panels 22 to aid in sealing the juncture between floor panels 22 and to allow for expansion of them.

Joining wall panels 20 to floor panels 22 may be achieved in the following manner. First wall panel 20 is secured to floor panel 22, with liquid nails or with any other appropriate wood seal or glue, where x-frame 55 abuts perimeter joists 72 and where bottom portion 64 abuts a lip 76, as shown in FIG. 5. A lag bolt may then be used to further secure x-frame 55 to perimeter joists 72. Bottom portion 64 may extend further below floor panel 22 to form overhang 65 (FIG. 5).

Ceiling panels (not shown) may also be created by constructing a thinner panel and eliminating the accompanying frame structure. The ceiling panel may be dropped into a ceiling system like any conventional ceiling panel. A frame structure would not be required since the ceiling panel would not be a weight bearing panel. The ceiling panel would create an option for a rustic interior ceiling.

Although specific dimensions of the various columns, panels and other components of the various embodiments of the invention have been given above, it is contemplated that these dimensions may be varied for particular purposes and structures as part of the invention.

While the invention has been described with reference to specific embodiments thereof, it will be appreciated that numerous variations, modifications, and embodiments are possible, and accordingly all such variations, modifications, and embodiments are to be regarded as being within the spirit and scope of the invention.

What is claimed is:

1. A modular panel system comprising:

(a) wall panels, each wall panel being fastenable to other wall panels and to a roofing assembly and having a long axis; and (b) floor panels, each floor panel being fastenable to other floor panels and to a wall panel, wherein each of said wall panels and floor panels comprises a plurality of columns, each of said columns comprising:

(i) a flat first side;

(ii) a second side opposite said first side;

(iii) a third side, a portion of which third side is perpendicular to said first side, said third side having a receptacle adjacent said first side and a protrusion adjacent said second side; and (iv) a fourth side, a portion of which fourth side is perpendicular to said first side, said fourth side having a protrusion adjacent said first side and a receptacle adjacent said second side; wherein the third and fourth sides of two adjacent columns may be fit together by insertion of the protrusion on the third side of a first column into the receptacle on the fourth side of a second column, and insertion of the protrusion on the fourth side of said second column into the receptacle on the third side of said first column, and wherein a plurality of adjacent columns may be joined together by said protrusions and receptacles to form sets of columns;

and wherein each of said wall panels comprises;

(i) an inside face, formed by the first side of each column of a first set of columns, said inside face having a bottom portion into which a floor panel fits, and (ii) an outside face formed by the second side of each column of said first set of columns;

and wherein each of said floor panels comprises:

(i) a top face being formed by the first side of each column of a second set of columns, and (ii) a bottom face being formed by the second side of each column of said second set of columns, wherein each of the columns in each of said wall panels extends vertically and parallel to the long axis of the panel when the wall panel is adjoined to a floor panel, and the wall panel is capable of aiding in roof support.

2. The modular panel system according to claim 1, wherein the second side of each of the columns is rounded.

3. The modular panel system according to claim 1, wherein the second side of each of the columns comprises a flat surface.

4. The modular panel system according to claim 1, further comprising a beam structure attached to the inside face of the wall panel.

5. The modular panel system according to claim 4, wherein the beam structure comprises a plurality of perimeter beams, which attach to the perimeter edges of the wall panel and to each other to form a plurality of corners; a plurality of transversing beams which extend diagonally between opposite corners of the perimeter beams to create a center point; and a plurality of short beams which attach through the center point widthwise between two perimeter beams.

6. The modular panel system according to claim 1, further comprising a joist structure attached to the top face of the floor panel.

7. The modular panel system according to claim 6, wherein the joist structure comprises a plurality of perimeter joists, which attach to the perimeter edges of the floor panel and to each other to form a plurality of corners; at least one center joist which extends the length of the floor panel and joins two perimeter joists; and a plurality of cross-joists which extend from the perimeter joists to the center joist.

8. The modular panel system according to claim 7, wherein the perimeter joist forms a lip along a side of the floor panel.

9. A modular panel system comprising a plurality of columns, each of said columns comprising:

(a) a flat first side;

(b) a second side opposite said first side;

(c) a third side, a portion of which third side is perpendicular to said first side, said third side having a receptacle adjacent said first side and a protrusion adjacent said second side; and (d) a fourth side, a portion of which fourth side is perpendicular to said first side, said fourth side having a protrusion adjacent said first side and a receptacle adjacent said second side; wherein the third and fourth sides of two adjacent columns may be fit together by insertion of the protrusion on the third side of a first column into the receptacle on the fourth side of a second column, and insertion of the protrusion on the fourth side of said second column into the receptacle on the third side of said first column, and wherein a plurality of adjacent columns may be joined together by said protrusions and receptacles to form sets of columns;

wherein each set forms a panel and wherein each of the columns in each panel is parallel to the long axis of said panel.

10. A modular panel system according to claim 9, wherein said columns are formed into a wall panel comprising:

(a) an inside face, formed by the first side of each column of a first set of columns, said inside face having a bottom portion into which a floor panel fits, and (b) an outside face formed by the second side of each column of said first set of columns, wherein said panel is capable in aiding in roof support.

11. The modular panel system according to claim 9, wherein the second side of each of the columns is rounded.

12. The modular panel system according to claim 9, wherein the second side of each of the columns comprises a flat surface.

13. The modular panel system according to claim 9, further comprising a beam structure attached to the inside face of the wall panel.

14. The modular panel system according to claim 9, wherein the beam structure comprises a plurality of perimeter beams, which attach to the perimeter edges of the wall panel and to each other to form a plurality of corners; a plurality of transversing beams which extend diagonally between opposite corners of the perimeter beams to create a center point; and a plurality of short beams which attach through the center point widthwise between two perimeter beams.

15. A modular panel system according to claim 9, wherein said columns are formed into a floor panel comprising:

(a) a top face being formed by the first side of each column of a second set of columns, and (b) a bottom face being formed by the second side of each column of said second set of columns.

16. The modular panel system according to claim 15, wherein the second side of each of the columns is rounded.

17. The modular panel system according to claim 15, wherein the second side of each of the columns comprises a flat surface

18. The modular panel system according to claim 15, further comprising a joist structure attached to the top face of the floor panel.

19. The modular panel system according to claim 18, wherein the joist structure comprises a plurality of perimeter joists, which attach to the perimeter edges of the floor panel and to each other to form a plurality of corners; at least one center joist which extends the length of the floor panel and joins two perimeter joists; and a plurality of cross-joists which extend from the perimeter joists to the center joist.

20. The modular panel system according to claim 19, wherein the perimeter joist forms a lip along a side of the floor panel.

21. A frame structure for a panel of parallel columns comprising:

(a) at least four perimeter beams joined to each other end to end to form a frame with a plurality of corners;

(b) a plurality of cross-beams extending diagonally between oppositely disposed corners of the frame through a center point inside the frame where the cross-beams intersect, wherein a first cross-beam is a single member, and the remaining cross-beams are severed into two members so that each cross-beam extends from a corner and is flush with the first cross-beam when intersecting at the center point; and (c) a plurality of short beams extending from a central area on a side of the frame to the center point and intersecting the cross-beams.

22. The frame structure according to claim 21, wherein the perimeter beams are mitered to meet at an angle of 45 degrees.

23. The frame structure according to claim 21, wherein the short beams are perpendicularly attached to the perimeter beams.

24. The frame structure according to claim 21 further comprising corner brackets attached to the perimeter beams at the outside corners, encasing the two perimeter beams constructing the corner.

25. The frame structure according to claim 24, further comprising grooved areas on the perimeter beams which have coinciding dimensions to the dimensions of the corner brackets and into which the corner brackets are insertable.

* * * * *